US012264376B2

(12) United States Patent
Fujimura et al.

(10) Patent No.: US 12,264,376 B2
(45) Date of Patent: Apr. 1, 2025

(54) DUPLEX STAINLESS STEEL AND METHOD FOR MANUFACTURING SAME, AND DUPLEX STAINLESS STEEL PIPE

(71) Applicant: JFE Steel Corporation, Tokyo (JP)

(72) Inventors: Kazuki Fujimura, Tokyo (JP); Kenichiro Eguchi, Tokyo (JP); Yusuke Yoshimura, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 635 days.

(21) Appl. No.: 17/613,316

(22) PCT Filed: Apr. 9, 2020

(86) PCT No.: PCT/JP2020/015983
§ 371 (c)(1),
(2) Date: Nov. 22, 2021

(87) PCT Pub. No.: WO2020/241084
PCT Pub. Date: Dec. 3, 2020

(65) Prior Publication Data

US 2022/0228231 A1 Jul. 21, 2022

(30) Foreign Application Priority Data

May 29, 2019 (JP) ..... 2019-099955

(51) Int. Cl.

| | |
|---|---|
| ***C21D 9/08*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |

(52) U.S. Cl.

CPC ..... *C21D 9/08* (2013.01); *C21D 6/004* (2013.01); *C21D 6/005* (2013.01); *C21D 6/007* (2013.01); *C21D 6/008* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/001* (2013.01); *C21D 2211/005* (2013.01)

(58) Field of Classification Search

CPC ..... C21D 9/08; C21D 6/004; C21D 6/005; C21D 2211/005; C21D 8/0247; C21D 2211/004; C21D 6/02; C22C 38/42; C22C 38/44

See application file for complete search history.

(56) References Cited

U.S. PATENT DOCUMENTS

| | | | | |
|---|---|---|---|---|
| 9,771,628 | B2 | 9/2017 | Motoya et al. | |
| 2013/0312880 | A1* | 11/2013 | Motoya | C22C 1/02 420/61 |
| 2019/0211416 | A1* | 7/2019 | Yoshimura | C22C 38/46 |
| 2019/0352752 | A1 | 11/2019 | Eguchi et al. | |

FOREIGN PATENT DOCUMENTS

| | | | |
|---|---|---|---|
| CN | 109295387 | A | 2/2019 |
| EP | 2677056 | A1 | 12/2013 |
| JP | 6123713 | A | 2/1986 |

(Continued)

OTHER PUBLICATIONS

International Search Report and Written Opinion for International Application No. PCT/JP2020/015983, dated Jul. 7, 2020, 5 pages.

(Continued)

*Primary Examiner* — Anthony M Liang
*Assistant Examiner* — Maxwell Xavier Duffy
(74) *Attorney, Agent, or Firm* — Buchanan Ingersoll & Rooney PC

(57) ABSTRACT

The invention is intended to provide a duplex stainless steel and a method for manufacturing same. A duplex stainless steel pipe is also provided. A duplex stainless steel of the present invention has a specific composition, and has a microstructure containing an austenitic phase and a ferrite phase. The duplex stainless steel satisfies the following contents for C, Si, Mn, Cr, Mo, Ni, N, Cu, and W in the formula (1) below, and has a yield strength YS of 655 MPa or more, and an absorption energy $vE_{-10}$ of 40 J or more as measured by a Charpy impact test at a test temperature of −10° C.

$$0.55[\%\ C]-0.056[\%\ Si]+0.018[\%\ Mn]-0.020[\%\ Cr]-0.087[\%\ Mo]+0.16[\%\ Ni]+0.28[\%\ N]-0.506[\%\ Cu]-0.035[\%\ W]+[\%\ Cu^*F]\leq 0.94 \quad (1)$$

6 Claims, No Drawings

(56) References Cited

FOREIGN PATENT DOCUMENTS

| | | | | |
|---|---|---|---|---|
| JP | 61157626 | A | 7/1986 | |
| JP | 1060526 | A | 3/1988 | |
| JP | 05247592 | A | 9/1993 | |
| JP | 07207337 | A | 8/1995 | |
| JP | 1060598 | A | 3/1998 | |
| JP | 2002241838 | A | 8/2002 | |
| JP | 2016117944 | A | 6/2016 | |
| WO | 2012111536 | A1 | 8/2012 | |
| WO | WO-2018043214 | A1 * | 3/2018 | ..... C21D 6/004 |
| WO | 2018131412 | A1 | 7/2018 | |

OTHER PUBLICATIONS

Final Office : U.S. Appl. No. 16/476,970, mailed Aug. 23, 2022, 10 pages.
Extended European Search Report for European Application No. 20812788.6, dated Sep. 22, 2022, 14 pages.

* cited by examiner

DUPLEX STAINLESS STEEL AND METHOD FOR MANUFACTURING SAME, AND DUPLEX STAINLESS STEEL PIPE

CROSS REFERENCE TO RELATED APPLICATIONS

This is the U.S. National Phase application of PCT/JP2020/015983, filed Apr. 9, 2020, which claims priority to Japanese Patent Application No. 2019-099955, filed May 29, 2019, the disclosures of these applications being incorporated herein by reference in their entireties for all purposes.

FIELD OF THE INVENTION

The present invention relates to a high-strength and high-toughness duplex stainless steel having excellent corrosion resistance suited for oil country tubular goods, and to a method for manufacturing such a duplex stainless steel. Specifically, the present invention relates to a duplex stainless steel for use as a steel pipe for oil country tubular goods, and to a method for manufacturing such a duplex stainless steel. The present invention also relates to a duplex stainless steel pipe using the duplex stainless steel.

BACKGROUND OF THE INVENTION

Increasing crude oil prices and an expected shortage of petroleum resources in the near future have prompted active development of oil country tubular goods for use in applications that were unthinkable in the past, for example, such as in deep oil fields, and in oil fields and gas fields of severe corrosive environments containing hydrogen sulfide, or sour environments as they are also called. Such oil fields and gas fields are typically very deep, creating a high-temperature atmosphere of a severe corrosive environment containing $CO_2$, $Cl^-$, and $H_2S$. Steel pipes for oil country tubular goods used in such an environment are required to have high strength and toughness, and desirable corrosion resistance (carbon dioxide corrosion resistance, sulfide stress corrosion cracking resistance, and sulfide stress cracking resistance).

In oil fields and gas fields of an environment containing substances such as $CO_2$ and $Cl^-$, a variety of duplex stainless steel pipes have traditionally been used as oil country tubular goods for mining of these fields. For example, PTL 1 discloses a method for manufacturing a high-strength duplex stainless steel having improved corrosion resistance. The method includes hot working a Cu-containing austenite-ferrite duplex stainless steel by heating to 1,000° C. or more, and directly quenching the steel from a temperature of 800° C. or more before aging.

PTL 2 discloses a method for manufacturing a seawater-resistant precipitation hardened duplex stainless steel. The method includes a solution treatment of a seawater-resistant precipitation hardened duplex stainless steel at 1,000° C. or more, and a subsequent aging heat treatment at 450 to 600° C. The stainless steel subjected to these processes is a stainless steel containing, in weight %, C: 0.03% or less, Si: 1% or less, Mn: 1.5% or less, P: 0.04% or less, S: 0.01% or less, Cr: 20 to 26%, Ni: 3 to 7%, Sol-Al: 0.03% or less, N: 0.25% or less, and Cu: 1 to 4%, and, additionally, at least one of Mo: 2 to 6% and W: 4 to 10%, all of Ca: 0 to 0.005%, Mg: 0 to 0.05%, B: 0 to 0.03%, and Zr: 0 to 0.3%, and a total of 0 to 0.03% Y, La, and Ce, and satisfying a PT value of PT≥35 as an index of seawater resistance, and a G value of 70≥G≥30 as an austenite fraction.

PTL 3 discloses a method for manufacturing a high-strength duplex stainless steel material that can be used in applications such as a logging line for oil country tubular goods in deep oil wells and gas wells. In this method, a Cu-containing austenite-ferrite duplex stainless steel material after a solution treatment is subjected to cold working that involves a percentage reduction of cross section of 35% or more, and, following cold working, the steel is quenched after being heated to a temperature region of 800 to 1,150° C. at a heating rate of 50° C./s or more. After warm working at 300 to 700° C., the steel is subjected to another cold working, with or without subsequent aging at 450 to 700° C.

PTL 4 discloses a method for manufacturing a duplex stainless steel for sour gas oil country tubular goods. The method includes a solution heat treatment at 1,000 to 1,150° C., and a subsequent aging heat treatment at 450 to 500° C. for 30 to 120 minutes, using a steel containing C: 0.02 wt % or less, Si: 1.0 wt % or less, Mn: 1.5 wt % or less, Cr: 21 to 28 wt %, Ni: 3 to 8 wt %, Mo: 1 to 4 wt %, N: 0.1 to 0.3 wt %, Cu: 2 wt % or less, W: 2 wt % or less, Al: 0.02 wt % or less, Ti, V, Nb, Ta: 0.1 wt % or less each, Zr, B: 0.01 wt % or less each, P: 0.02 wt % or less, and S: 0.005 wt % or less.

PTL 5 discloses a method for manufacturing a high-strength and high-toughness duplex stainless steel, using a steel containing C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, and N: less than 0.07%. The method includes a solution heat treatment in which the steel is heated to a temperature of 1,000° C. or more, and cooled to a temperature of 300° C. or less at an average cooling rate of air cooling or faster, and a subsequent aging heat treatment that heats the steel to 350° C. to 600° C. before cooling.

PATENT LITERATURE

PTL 1: JP-A-S61-23713
PTL 2: JP-A-H10-60526
PTL 3: JP-A-H07-207337
PTL 4: JP-A-S61-157626
PTL 5: Domestic Re-publication of PCT Patent Application, No. 2018-43214

SUMMARY OF THE INVENTION

The recent development of oil fields and gas fields of increasing severe corrosive environments has demanded a high-strength and high-toughness steel pipe for oil country tubular goods having excellent corrosion resistance. Here, "excellent corrosion resistance" means having excellent carbon dioxide corrosion resistance at high temperatures of 200° C. and higher, excellent sulfide stress corrosion cracking resistance (SCC resistance) at low temperatures of 80° C. and less, and excellent sulfide stress cracking resistance (SSC resistance) at an ordinary temperature of 20 to 30° C., particularly in a severe corrosive environment containing $CO_2$, $Cl^-$, and $H_2S$. There is also demand for improved economy (cost and efficiency).

However, the steels described in PTL 1 to PTL 4 do not take into consideration low-temperature sulfide stress corrosion cracking resistance at 80° C. or less. Sulfide stress cracking resistance is also not taken into account in these related art documents. It is stated in PTL 5 that the steel disclosed therein has desirable low-temperature sulfide stress corrosion cracking resistance at 80° C. or less, and desirable sulfide stress cracking resistance. However, PTL 5 does not describe whether pitting corrosion is present or absent at low temperatures of 80° C. and less.

Aspects of the present invention have been made to provide a solution to the foregoing problems, and it is an object according to aspects of the present invention to provide a high-strength and high-toughness duplex stainless steel having excellent corrosion resistance, and a method for manufacturing such a duplex stainless steel. Here, "excellent corrosion resistance" means having excellent carbon dioxide corrosion resistance, excellent sulfide stress corrosion cracking resistance, and excellent sulfide stress cracking resistance even in a severe corrosive environment such as above. A pipe made of such a duplex stainless steel is suitable for use in a severe environment such as in crude oil or natural gas wells, and in gas wells.

As used herein, "high strength" means strength with a yield strength of 95 ksi (655 MPa) or more. As used herein, "high toughness" means low-temperature toughness, specifically an absorption energy $vE_{-10}$ of 40 J or more as measured by a Charpy impact test at −10° C. As used herein, "excellent carbon dioxide corrosion resistance" means that a test specimen immersed in a test solution (a 20 mass % NaCl aqueous solution; liquid temperature: 200° C.; a 3.0 MPa $CO_2$ gas atmosphere) held in an autoclave has a corrosion rate of 0.125 mm/y or less with no pitting corrosion after 336 hours of immersion in the solution. As used herein "excellent sulfide stress corrosion cracking resistance" means that a test specimen immersed in a test solution (a 10 mass % NaCl aqueous solution; liquid temperature: 80° C.; an atmosphere of 2 MPa $CO_2$ gas and 35 kPa $H_2S$) held in an autoclave does not have cracks and pitting corrosion after 720 hours of immersion under an applied stress equal to 100% of the yield stress. As used herein, "excellent sulfide stress cracking resistance" means that a test specimen immersed in a test solution (an aqueous solution with an adjusted pH of 3.5 by addition of acetic acid and sodium acetate to a 20 mass % NaCl aqueous solution (liquid temperature: 25° C.; an atmosphere of 0.07 MPa $CO_2$ gas and 0.03 MPa $H_2S$)) held in a test cell does not have cracks and pitting corrosion after 720 hours of immersion under an applied stress equal to 90% of the yield stress.

In order to achieve the foregoing object, the present inventors conducted intensive studies of various factors that affect the strength, toughness, carbon dioxide corrosion resistance, sulfide stress corrosion cracking resistance, and sulfide stress cracking resistance of a duplex stainless steel. The studies led to the following findings:

1) In a duplex stainless steel containing 2.0% or more of Cu, copper tends to assume a supersaturated state in the ferrite phase during cooling after hot rolling, and creates coarse ε-Cu precipitates in the ferrite phase.
2) The coarse ε-Cu after hot rolling is not easily removable by an ordinary solution treatment, and removal requires long hours of heating.
3) In a material subjected to solution treatment and aging, the coarse ε-Cu remaining in the ferrite phase becomes an initiation point of corrosion, and tends to cause selective corrosion in ferrite phase by providing an initiation point of pitting corrosion.
4) Supersaturation of copper can be overcome by a heat treatment that causes precipitation of the σ phase that hardly dissolves copper. Brief heating in the heat treatment promotes migration of copper from ferrite phase to austenitic phase, and the amount of coarse ε-Cu in the ferrite phase can be greatly reduced by a subsequent solution treatment.
5) The coarse ε-Cu being present or absent in the ferrite phase has a correlation with the degree of supersaturation of copper, and the resistance to selective corrosion improves when C, Si, Mn, Cr, Mo, Ni, N, Cu, and W satisfy the following content ranges so as to satisfy the following formula (1).

$$0.55[\%\ C]-0.056[\%\ Si]+0.018[\%\ Mn]-0.020[\%\ Cr]-0.087[\%\ Mo]+0.16[\%\ Ni]+0.28[\%\ N]-0.506[\%\ Cu]-0.035[\%\ W]+[\%\ Cu^*F]\geq 0.94 \quad (1)$$

In the formula (1), [% symbol of elements] represents the content (mass %) of the element in the steel, and [% symbol of elements*F] represents the content (mass %) of the element in the ferrite phase. The contents are zero for elements that are not contained.

Aspects of the present invention were completed on the basis of these findings, and are as follows.

[1] A duplex stainless steel having a composition including, in mass %, C: 0.03% or less, Si: 1.0% or less, Mn: 0.10 to 1.5%, P: 0.040% or less, S: 0.01% or less, Cr: 20.0 to 28.0%, Ni: 2.0 to 10.0%, Mo: 2.0 to 5.0%, Cu: 2.0 to 6.0%, Al: 0.001 to 0.05%, and N: less than 0.070%, and in which the balance is Fe and incidental impurities, the duplex stainless steel having a microstructure containing an austenitic phase and a ferrite phase, and satisfying the following contents for C, Si, Mn, Cr, Mo, Ni, N, Cu, and W in the formula (1) below, the duplex stainless steel having a yield strength YS of 655 MPa or more, and an absorption energy $vE_{-10}$ of 40 J or more as measured by a Charpy impact test at a test temperature of −10° C., $$0.55[\%\ C]-0.056[\%\ Si]+0.018[\%\ Mn]-0.020[\%\ Cr]-0.087[\%\ Mo]+0.16[\%\ Ni]+0.28[\%\ N]-0.506[\%\ Cu]-0.035[\%\ W]+[\%\ Cu^*F]\geq 0.94 \quad (1),$$

wherein [% symbol of elements] represents the content (mass %) of the element in the steel, [% symbol of elements *F] represents the content (mass %) of the element in the ferrite phase, and the contents are zero for elements that are not contained.

[2] The duplex stainless steel according to [1], wherein the composition further includes, in mass %, one or two or more groups selected from the following groups A to E, group A: W: 1.5% or less, group B: V: 0.20% or less, group C: one or two selected from Zr: 0.50% or less, and B: 0.0030% or less, group D: one or two or more selected from REM: 0.005% or less, Ca: 0.005% or less, Sn: 0.20% or less, and Mg: 0.01% or less, group E: one or two or more selected from Ta: 0.1% or less, Co: 1.0% or less, and Sb: 1.0% or less.

[3] A duplex stainless steel pipe using the duplex stainless steel of [1] or [2].

[4] A method for manufacturing a duplex stainless steel, including subjecting a steel material of the composition of [1] or [2] to a σ-phase precipitation treatment that heats the steel material to a temperature of 700° C. or more and 950° C. or less, and cools the heated steel material to a temperature of 300° C. or less at an average cooling rate of air cooling or faster, a solution heat treatment that heats the steel material to a temperature of 1,000° C. or more, and cools the heated steel material to a temperature of 300° C. or less at an average cooling rate of air cooling or faster, and an aging heat treatment that heats the steel material to a temperature of 350 to 600° C., and cools the heated steel material.

In accordance with aspects of the present invention, a duplex stainless steel can be obtained that has high strength with a yield strength of 95 ksi or more (655 MPa or more), high toughness with an absorption energy $vE_{-10}$ of 40 J or more as measured by a Charpy impact test at −10° C., and excellent corrosion resistance, including excellent carbon dioxide corrosion resistance, excellent sulfide stress corrosion cracking resistance, and excellent sulfide stress cracking resistance, even in a severe corrosive environment containing hydrogen sulfide.

A duplex stainless steel manufactured in accordance with aspects of the present invention is applicable to a stainless steel seamless pipe for oil country tubular goods. This makes the present invention highly useful in industry.

DETAILED DESCRIPTION OF EMBODIMENTS OF THE INVENTION

Composition of Duplex Stainless Steel

The reasons for limiting the composition of a duplex stainless steel according to aspects of the present invention are described first. In the following, "%" used in conjunction with contents of components is percent by mass.

C: 0.03% or Less

C is an element with the effect to improve strength and low-temperature toughness by stabilizing the austenitic phase. The C content is preferably 0.002% or more to achieve high strength with a yield strength of 95 ksi or more (655 MPa or more), and low-temperature toughness with an absorption energy $vE_{-10}$ of 40 J or more in a Charpy impact test. The C content is more preferably 0.005% or more. A C content of more than 0.03% may lead to excessive carbide precipitation in a heat treatment, and cause adverse effect on corrosion resistance. For this reason, the C content is 0.03% or less. Preferably, the C content is 0.02% or less. The C content is more preferably 0.015% or less, even more preferably 0.012% or less.

Si: 1.0% or Less

Si is an element that serves as a deoxidizing agent. The Si content is preferably 0.05% or more to obtain this effect. More preferably, the Si content is 0.10% or more. A Si content of more than 1.0%, however, leads to excessive intermetallic compound precipitation in a heat treatment, and impairs the corrosion resistance of steel. For this reason, the Si content is 1.0% or less. The Si content is preferably 0.8% or less, more preferably 0.7% or less, even more preferably 0.6% or less.

Mn: 0.10 to 1.5%

Mn is an element that is effective as a deoxidizing agent, as is Si. Mn improves hot workability by fixing the incidental element S in the steel in the form of a sulfide. These effects can be obtained when the Mn content is 0.10% or more. For this reason, the Mn content is 0.10% or more. The Mn content is preferably 0.15% or more, more preferably 0.20% or more. A Mn content of more than 1.5% causes adverse effect on corrosion resistance, in addition to impairing hot workability. For this reason, the Mn content is 1.5% or less. The Mn content is preferably 1.0% or less, more preferably 0.8% or less, even more preferably 0.5% or less.

P: 0.040% or Less

P is an element that decreases the corrosion resistance of the duplex stainless steel, and the corrosion resistance becomes seriously impaired when the P content is more than 0.040%. For this reason, the P content is 0.040% or less. Preferably, the P content is 0.020% or less. However, in order to reduce the P content to less than 0.005%, a long process time is required for removal of phosphorus in the process of refining molten iron, and this increases the manufacturing cost of duplex stainless steel. For this reason, the P content is preferably 0.005% or more.

S: 0.01% or Less

S is an element that impairs hot workability in production of a duplex stainless steel, and causes trouble in manufacture of a duplex stainless steel when contained in an amount of more than 0.01%. For this reason, the S content is 0.01% or less. Preferably, the S content is 0.005% or less. From the viewpoint of preventing increase of manufacturing cost, the S content is preferably 0.0005% or more.

Cr: 20.0 to 28.0%

Cr is a basic component that is effective for maintaining corrosion resistance and improving strength. The Cr content is 20.0% or more to obtain these effects. For improved strength, the Cr content is preferably 21.0% or more, more preferably 23.0% or more. A Cr content of more than 28.0% encourages precipitation of the a phase, and impairs both corrosion resistance and toughness. For this reason, the Cr content is 28.0% or less. From the viewpoint of toughness, the Cr content is preferably 27.0% or less.

Ni: 2.0 to 10.0%

Ni is an element that is contained to stabilize the austenitic phase and create a duplex microstructure. This effect cannot be obtained when the Ni content is less than 2.0%. For this reason, the Ni content is 2.0% or more. The Ni content is preferably 3.0% or more. The Ni content is more preferably 4.0% or more. With a Ni content of more than 10.0%, the austenitic phase predominates, and the strength desired in accordance with aspects of the present invention cannot be obtained. Because Ni is an expensive element, a Ni content of more than 10.0% is also not desirable from an economic standpoint. For this reason, the Ni content is 10.0% or less. Preferably, the Ni content is 8.0% or less.

Mo: 2.0 to 5.0%

Mo is an element that acts to improve the corrosion resistance of duplex stainless steel, and contributes to preventing corrosion, particularly pitting corrosion due to $Cl^-$. This effect cannot be obtained when the Mo content is less than 2.0%. For this reason, the Mo content is 2.0% or more. Preferably, the Mo content is 2.5% or more. A Mo content of more than 5.0% causes σ phase precipitation, and impairs toughness and corrosion resistance. For this reason, the Mo content is 5.0% or less. Preferably, the Mo content is 4.5% or less.

Cu: 2.0 to 6.0%

Cu greatly improves strength by forming fine ε-Cu precipitates in an aging heat treatment. Cu also strengthens the protective coating to reduce entry of hydrogen into steel, and improves sulfide stress cracking resistance and sulfide stress corrosion cracking resistance. This makes Cu a very important element in accordance with aspects of the present invention. The Cu content is 2.0% or more to obtain these effects. Preferably, the Cu content is 2.5% or more. A Cu content of more than 6.0% impairs low-temperature toughness. For this reason, the Cu content is 6.0% or less. The Cu content is preferably 5.5% or less. The Cu content is more preferably 5.0% or less.

Al: 0.001 to 0.05%

Al is an element that serves as a deoxidizing agent in the process of refining raw material molten iron in duplex stainless steel production. This effect cannot be obtained when the Al content is less than 0.001%. For this reason, the Al content is 0.001% or more. Preferably, the Al content is 0.005% or more. An Al content of more than 0.05% encourages precipitation of alumina inclusions, and impairs hot workability in the production of a duplex stainless steel, with the result that toughness also decreases. For this reason, the Al content is 0.05% or less. Preferably, the Al content is 0.04% or less.

N: Less Than 0.070%

In typical duplex stainless steels, N is known to improve pitting corrosion resistance, and contribute to solid solution strengthening. To this end, N is actively added in an amount of 0.10% or more. However, in an aging heat treatment, N forms various nitrides, and decreases sulfide stress corrosion cracking resistance in a low temperature range of 80° C. or less, in addition to decreasing sulfide stress cracking resistance. This becomes more prominent when the N content is 0.070% or more. For this reason, the N content is less than 0.070%. The N content is preferably 0.05% or less, more preferably 0.04% or less, further preferably 0.03% or less, even more preferably 0.015% or less. The N content is preferably 0.001% or more to obtain the properties desired in accordance with aspects of the present invention. More preferably, the N content is 0.005% or more.

The balance is Fe and incidental impurities. Examples of the incidental impurities include O (oxygen), and an O content of 0.01% or less is acceptable.

These represent the basic components. In addition to the foregoing basic components, the composition may optionally contain one or two or more groups selected from the following groups A to E, as required.

Group A: W: 1.5% or Less

W is useful as an element that improves sulfide stress corrosion cracking resistance and sulfide stress cracking resistance. Desirably, W is contained in an amount of 0.02% or more to obtain this effect. The W content is more preferably 0.3% or more, even more preferably 0.8% or more. When contained in an excessively large amount of more than 1.5%, W may cause decrease of low-temperature toughness. For this reason, W, when contained, is contained in an amount of 1.5% or less. More preferably, the W content is 1.2% or less.

Group B: V: 0.20% or Less

V is useful as an element that improves steel strength by precipitation hardening. Desirably, V is contained in an amount of 0.02% or more to obtain this effect. More preferably, the V content is 0.04% or more. When contained in an amount of more than 0.20%, V may cause decrease of low-temperature toughness. An excessively high V content may result in decrease of sulfide stress cracking resistance. For this reason, V, when contained, is contained in an amount of 0.20% or less. More preferably, the V content is 0.08% or less.

Group C: One or Two Selected from Zr: 0.50% or Less, and B: 0.0030% or Less

Zr and B are useful as elements that contribute to increasing strength, and may be selectively contained, as required.

Zr also contributes to improving sulfide stress corrosion cracking resistance, in addition to increasing strength. Desirably, Zr is contained in an amount of 0.02% or more to obtain these effects. More preferably, the Zr content is 0.05% or more. When contained in an amount of more than 0.50%, Zr may cause decrease of low-temperature toughness. For this reason, Zr, when contained, is contained in an amount of 0.50% or less. More preferably, the Zr content is 0.20% or less.

B is useful as an element that also contributes to improving hot workability, in addition to increasing strength. Desirably, B is contained in an amount of 0.0005% or more to obtain these effects. More preferably, the B content is 0.0010% or more. When contained in an amount of more than 0.0030%, B may cause decrease of low-temperature toughness and hot workability. For this reason, B, when contained, is contained in an amount of 0.0030% or less. More preferably, the B content is 0.0025% or less.

Group D: One or Two or More Selected from REM: 0.005% or Less, Ca: 0.005% or Less, Sn: 0.20% or Less, and Mg: 0.01% or Less REM, Ca, Sn, and Mg are all useful as elements that contribute to improving sulfide stress corrosion cracking resistance, and may be selectively contained, as required. The preferred contents for obtaining this effect are REM: 0.001% or more, Ca: 0.001% or more, Sn: 0.05% or more, and Mg: 0.0002% or more. More preferably, the contents are REM: 0.0015% or more, Ca: 0.0015% or more, Sn: 0.09% or more, and Mg: 0.0005% or more. When the contents are more than REM: 0.005%, Ca: 0.005%, Sn: 0.20%, and Mg: 0.01%, the increased contents do not always produce the expected effect because of saturation of the effect, and this may pose an economic drawback. For this reason, when contained, the contents of these elements are REM: 0.005% or less, Ca: 0.005% or less, Sn: 0.20% or less, and Mg: 0.01% or less. More preferably, the contents are REM: 0.004% or less, Ca: 0.004% or less, Sn: 0.15% or less, and Mg: 0.005% or less.

Group E: One or Two or More Selected from Ta: 0.1% or Less, Co: 1.0% or Less, and Sb: 1.0% or Less Ta, Co, and Sb are all useful as elements that contribute to improving carbon dioxide corrosion resistance, sulfide stress cracking resistance, and sulfide stress corrosion cracking resistance, and may be selectively contained, as required. When contained to produce this effect, the contents of these elements are Ta: 0.01% or more, Co: 0.01% or more, and Sb: 0.01% or more. More preferably, the contents are Ta: 0.02% or more, Co: 0.02% or more, and Sb: 0.02% or more. When the contents are more than Ta: 0.1%, Co: 1.0%, and Sb: 1.0%, the increased contents do not always produce the expected effect because of saturation of the effect. For this reason, when contained, the contents of these elements are Ta: 0.1% or less, Co: 1.0% or less, and Sb: 1.0% or less. More preferably, the contents are Ta: 0.05% or less, Co: 0.5% or less, and Sb: 0.5% or less.

The contents of C, Si, Mn, Cr, Mo, Ni, N, Cu, and, optionally, W are adjusted to satisfy the following formula (1). In formula (1), [% symbol of elements] represents the content (mass %) of the element in the steel, and [% symbol of elements *F] represents the content (mass %) of the element in the ferrite phase. The contents are zero for elements that are not contained.

$$0.55[\%\ C]-0.056[\%\ Si]+0.018[\%\ Mn]-0.020[\%\ Cr]-0.087[\%\ Mo]+0.16[\%\ Ni]+0.28[\%\ N]-0.506[\%\ Cu]-0.035[\%\ W]+[\%\ Cu*F]0.94 \quad (1)$$

The pitting corrosion resistance improves when the contents of C, Si, Mn, Cr, Mo, Ni, N, Cu, and, optionally, W, and the content of Cu in the ferrite phase satisfy the formula (1). On the left-hand side of formula (1), a value obtained by multiplying the value of the linear expression of the contents of the components (the left-hand side of formula (1) excluding [% Cu*F]) by −1 approximates to the equilibrium value of the Cu content in the ferrite phase. That is, the value on the left-hand side of formula (1) represents the difference between the equilibrium value of the Cu content in the ferrite phase and the Cu content in the ferrite phase, and corresponds to the degree of supersaturation of copper. The value on the left-hand side of formula (1) is an index of an amount of coarse ε-Cu in the ferrite phase so that the amount of coarse ε-Cu increases, and the pitting corrosion resistance decreases as the value on the left-hand side of formula (1)

increases. From the viewpoint of further improving the pitting corrosion resistance, the value on the left-hand side of formula (1) is preferably 0.92 or less. The lower limit is not particularly limited. From the viewpoint of ensuring stable strength, the value on the left-hand side of formula (1) is preferably 0.80 or more.

The Cu content in the ferrite phase can be determined as follows, for example. When the duplex stainless steel according to aspects of the present invention is a seamless steel pipe, a test specimen for microstructure observation is taken for observation of a surface of an axial cross section, and the ferrite phase is identified by EBSP (Electron Back Scattering Pattern) analysis. The ferrite phase identified in each test specimen is then measured for Cu content at arbitrarily selected 20 points, using a FE-EPMA (Field Emission Electron Probe Micro Analyzer). A mean value of the quantified Cu content values is determined as the Cu content of the ferrite phase in the steel.

Microstructure of Duplex Stainless Steel

The duplex stainless steel according to aspects of the present invention has a microstructure containing an austenitic phase and a ferrite phase. The volume fraction (%) of the austenitic phase is preferably 20 to 70%. The volume fraction (%) of the ferrite phase is preferably 30 to 80%. Less than 20% austenitic phase may result in decrease of low-temperature toughness, sulfide stress cracking resistance, and sulfide stress corrosion cracking resistance. More than 70% austenitic phase may result in decrease of strength. The austenitic phase is more preferably 25% or more, even more preferably 65% or less. Less than 30% ferrite phase may result in decrease of strength. More than 80% ferrite phase may result in decrease of low-temperature toughness, sulfide stress cracking resistance, and sulfide stress corrosion cracking resistance. The ferrite phase is more preferably 35% or more, even more preferably 75% or less. In accordance with aspects of the present invention, the volume fraction of each phase can be measured using the method described in the Examples below.

Duplex Stainless Steel Manufacturing Method

A method for manufacturing a duplex stainless steel pipe is described below as an exemplary method of manufacture of a duplex stainless steel according to aspects of the present invention. The method described below is based on an example in which the duplex stainless steel according to aspects of the present invention is a seamless steel pipe. Aspects of the present invention are applicable not only to seamless steel pipes but to a variety of other forms of steel, including, for example, thin steel sheets, thick steel sheets, UOE, ERW, spiral steel pipes, and butt-welded pipes.

In accordance with aspects of the present invention, a steel material (e.g., a billet) of the foregoing composition is used as a starting material (hereinafter, referred to also as "steel pipe material"). In accordance with aspects of the present invention, the method used to produce the starting material is not particularly limited, and common known methods may be used.

For example, in a preferred manufacturing method of a steel pipe material of the foregoing composition, molten iron of the foregoing composition is refined into steel by an ordinary steelmaking process such as by using a converter, and processed into a steel pipe material by using a common known method, such as continuous casting and ingot making-blooming. The steel pipe material is then heated to produce a seamless steel pipe of the foregoing composition and desired dimensions, using a common known technique such as Eugene Sejerne extrusion process or Mannesmann pipe-making process.

The heating temperature for the steel pipe material is preferably, for example, 1,100 to 1,300° C. A heating temperature of less than 1,100° C. may impair material workability, and cause cracks in the outer surface of the steel pipe during rolling. A heating temperature of more than 1,300° C. may result in melting the material by heat generated during working beyond the melting point of the material, causing difficulty in a subsequent rolling process.

From the viewpoint of introducing increased numbers of dislocations and grain boundaries to provide a core for precipitation of copper, and producing a high-strength material in a subsequent aging heat treatment, it is preferable that the total reduction in the hot working be 20 to 60% in a temperature range of, for example, 800 to 1,300° C. A temperature of less than 800° C. may impair material workability, and cause cracks in the outer surface of the steel pipe during rolling. A temperature of more than 1,300° C. may result in melting the material by heat generated during working beyond the melting point of the material, causing difficulty in a subsequent rolling process. When the total reduction is less than 20% in the foregoing temperature region, it may not be possible to produce sufficient numbers of dislocations and grain boundaries as a core for precipitation of copper, and obtain a sufficient level of high strength. Rolling with a total reduction of more than 60% may produce excessively large heat by working, and this may result in melting the material by heat generated during working beyond the melting point of the material, causing difficulty in a subsequent rolling process. As used herein, "total reduction" refers to reduction of the wall thickness of the steel pipe after the rolling performed with an elongator, a plug mill, or the like following piercing with a piercer.

After pipe-making, the seamless steel pipe is cooled. Preferably, in the case of the foregoing composition, the seamless steel pipe is cooled to room temperature at an average cooling rate of air cooling or faster. In this way, the seamless steel pipe can have the microstructure described above.

In accordance with aspects of the present invention, the cooled seamless steel pipe is subjected to a σ-phase precipitation treatment, a solution heat treatment, and an aging heat treatment, in this order, to produce the duplex stainless steel pipe.

σ-Phase Precipitation Treatment

Next, the seamless steel pipe is subjected to a σ-phase precipitation treatment, an important process in accordance with aspects of the present invention. Specifically, in accordance with aspects of the present invention, a seamless steel pipe of the foregoing composition is heated at heating temperature of 700° C. or more and 950° C. or less, and cooled to a temperature of 300° C. or less at an average cooling rate of air cooling or faster, specifically, at an average cooling rate of 1° C./s or more. This causes the σ phase to precipitate, and overcomes the supersaturated state of copper in the ferrite phase. The degree of supersaturation of copper in the ferrite phase corresponds to formula (1). The σ-phase precipitation treatment can produce a duplex stainless steel pipe satisfying the formula (1). From the viewpoint of promoting σ-phase precipitation, the heating temperature in the σ-phase precipitation treatment is preferably 900° C. or less. Preferably, the heating temperature of the σ-phase precipitation treatment is 750° C. or more. From the viewpoint of creating a uniform temperature in the material, the σ-phase precipitation treatment retains the foregoing heating temperature for preferably at least 5 minutes, more preferably at least 10 minutes. Preferably, the σ-phase precipitation treatment retains the foregoing heating temperature for at most 300 minutes, more preferably at most 100 minutes. The average cooling rate of the cooling in the σ-phase precipitation treatment is preferably 2° C./s or more. The cooling may be, for example, air cooling or water cooling. The upper limit of average cooling rate is not particularly limited; however, the average cooling rate is preferably 50° C./s or less because the effect on material characteristics becomes saturated with increase of average cooling rate. As used herein, "average cooling rate" means the average rate of cooling from the heating temperature to a cooling stop temperature. When the cooling stop temperature of the σ-phase precipitation treatment is more than 300° C., the added copper precipitates into coarse ε-Cu during cooling, and a considerably long heating time will be required to redissolve the copper into a solid solution in the subsequent solution treatment, with the result that the productivity decreases. A failure to sufficiently redissolve copper in the subsequent solution heat treatment results in decreased toughness due to the remaining coarse ε-Cu. For this reason, the cooling stop temperature in the σ-phase precipitation treatment is preferably 300° C. or less, more preferably 250° C. or less.

Solution Heat Treatment

In accordance with aspects of the present invention, the σ-phase precipitation treatment is followed by a solution heat treatment of the seamless steel pipe subjected to the σ-phase precipitation treatment. Specifically, the seamless steel pipe subjected to the σ-phase precipitation treatment is further heated to a temperature of 1,000° C. or more, and cooled to a temperature of 300° C. or less at an average cooling rate of air cooling or faster, specifically, at an average cooling rate of 1° C./s or more. In this way, intermetallic compounds, carbides, nitrides, sulfides, and other such precipitates formed before or during the σ-phase precipitation treatment can be dissolved into solid solutions, and the resulting seamless steel pipe can have a microstructure containing appropriate amounts of austenitic phase and ferrite phase.

The desired high toughness cannot be ensured when the heating temperature of the solution heat treatment is less than 1,000° C. Preferably, the heating temperature of the solution heat treatment is 1,020° C. or more. From the viewpoint of preventing coarsening of the microstructure, the heating temperature of the solution heat treatment is preferably 1,150° C. or less. More preferably, the heating temperature of the solution heat treatment is 1,130° C. or less. In accordance with aspects of the present invention, from the viewpoint of creating a uniform temperature in the material, the solution heat treatment retains the foregoing heating temperature for preferably at least 5 minutes, more preferably at least 10 minutes. Preferably, the solution heat treatment retains the foregoing heating temperature for at most 210 minutes, more preferably at most 100 minutes.

When the average cooling rate of the solution heat treatment is less than 1° C./s, precipitation of intermetallic compounds such as the σ phase and χ phase occurs in the cooling process, and the low-temperature toughness and corrosion resistance seriously decrease. The upper limit of average cooling rate is not necessarily particularly limited. The cooling rate of the cooling in the solution heat treatment is preferably 2° C./s or more.

When the cooling stop temperature of the solution heat treatment is more than 300° C., the added copper precipitates into coarse ε-Cu during cooling, and the desired high strength and high toughness, and desirable corrosion resistance cannot be ensured. For this reason, the cooling stop temperature of the solution heat treatment is 300° C. or less, more preferably 250° C. or less.

Aging Heat Treatment

After the solution heat treatment, the seamless steel pipe is subjected to an aging heat treatment. Specifically, the seamless steel pipe subjected to the solution heat treatment is heated to a temperature of 350 to 600° C., and cooled. The aging heat treatment contributes to strength by causing the added copper to form fine ε-Cu precipitates. The fine ε-Cu does not provide an initiation point of selective corrosion of the ferrite phase, and, accordingly, does not serve as an initiation point of pitting corrosion. The aging heat treatment of the seamless steel pipe produces a high-strength duplex stainless steel pipe having the desired high strength and high toughness, and excellent corrosion resistance.

Coarsening of ε-Cu occurs when the aging heat treatment is performed at a high heating temperature of more than 600° C. In this case, the product stainless steel pipe cannot have the desired high strength and high toughness, and desirable corrosion resistance. Preferably, the heating temperature of the aging heat treatment is 550° C. or less. When the heating temperature of the aging heat treatment is less than 350° C., fine precipitation of ε-Cu does not sufficiently take place, and the desired high strength cannot be obtained. Preferably, the heating temperature of the aging heat treatment is 400° C. or more. In accordance with aspects of the present invention, from the viewpoint of creating a uniform temperature in the material, the aging heat treatment retains the foregoing heating temperature for preferably at least 5 minutes. The microstructure cannot have the desired uniformity when the aging heat treatment is retained for less than 5 minutes. More preferably, the aging heat treatment is retained for at least 20 minutes. Preferably, the aging heat treatment is retained for at most 210 minutes. In the aging heat treatment, "cooling" means cooling from a temperature region of 350 to 600° C. to room temperature at an average cooling rate of air cooling or faster. Specifically, the average cooling rate of air cooling or faster is 1° C./s or more. The cooling rate of the cooling in the aging heat treatment is preferably 2° C./s or more.

Example 1

Examples of the present invention are described below. It is to be noted that the present invention is not limited to the following Examples.

Molten irons of the compositions shown in Table 1 were separately refined into steel using a converter, and cast into a billet (steel pipe material) by continuous casting. After being heated at 1,150 to 1,250° C., the steel pipe material was formed into a pipe by hot working using a heating model seamless rolling mill to produce a seamless steel pipe measuring 83.8 mm in outer diameter and 12.7 mm in wall thickness. After production, the seamless steel pipe was air cooled. The hot working was carried out with a total reduction of 20 to 60% in a temperature region of 800 to 1,300° C.

TABLE 1

| Steel No. | Composition (mass %) C | Si | Mn | P | S | Cr | Ni | Mo | Cu | Al | N |
|---|---|---|---|---|---|---|---|---|---|---|---|
| A | 0.012 | 0.52 | 0.28 | 0.011 | 0.0011 | 22.4 | 6.4 | 3.1 | 2.9 | 0.012 | 0.018 |
| B | 0.022 | 0.27 | 0.52 | 0.013 | 0.0010 | 25.3 | 7.0 | 4.2 | 3.0 | 0.015 | 0.012 |
| C | 0.008 | 0.55 | 0.66 | 0.015 | 0.0013 | 22.2 | 6.4 | 2.8 | 2.7 | 0.016 | 0.015 |
| D | 0.016 | 0.25 | 0.76 | 0.011 | 0.0008 | 24.7 | 6.8 | 3.1 | 3.2 | 0.011 | 0.022 |
| E | 0.007 | 0.19 | 0.11 | 0.010 | 0.0011 | 24.6 | 6.1 | 3.3 | 4.6 | 0.016 | 0.068 |
| F | 0.009 | 0.68 | 0.66 | 0.015 | 0.0013 | 21.4 | 4.6 | 4.8 | 3.2 | 0.018 | 0.026 |
| G | 0.021 | 0.54 | 0.89 | 0.017 | 0.0014 | 26.7 | 3.4 | 2.2 | 3.5 | 0.013 | 0.055 |
| H | 0.015 | 0.43 | 0.49 | 0.014 | 0.0009 | 22.3 | 5.8 | 3.0 | 3.1 | 0.022 | 0.041 |
| I | 0.013 | 0.35 | 0.23 | 0.014 | 0.0011 | 26.8 | 5.6 | 2.1 | 2.9 | 0.026 | 0.039 |
| J | 0.007 | 0.77 | 1.48 | 0.010 | 0.0011 | 24.3 | 7.9 | 2.2 | 3.2 | 0.016 | 0.026 |
| K | 0.028 | 0.91 | 0.87 | 0.012 | 0.0013 | 24.5 | 7.5 | 3.1 | 2.4 | 0.011 | 0.014 |
| L | 0.069 | 0.61 | 0.78 | 0.013 | 0.0011 | 22.2 | 6.2 | 1.6 | 2.6 | 0.013 | 0.016 |
| M | 0.016 | 0.88 | 0.49 | 0.016 | 0.0013 | 22.5 | 6.5 | 2.8 | 1.3 | 0.013 | 0.016 |
| N | 0.015 | 0.55 | 1.58 | 0.015 | 0.0009 | 22.6 | 6.1 | 2.5 | 2.5 | 0.016 | 0.018 |
| O | 0.011 | 1.11 | 0.88 | 0.015 | 0.0009 | 22.6 | 6.1 | 2.5 | 2.5 | 0.016 | 0.018 |
| P | 0.022 | 0.54 | 0.13 | 0.015 | 0.0014 | 29.9 | 5.9 | 2.3 | 2.3 | 0.016 | 0.022 |
| Q | 0.021 | 0.31 | 0.88 | 0.016 | 0.0011 | 24.2 | 10.8 | 3.2 | 3.1 | 0.022 | 0.043 |
| R | 0.011 | 0.25 | 0.54 | 0.011 | 0.0013 | 25.4 | 6.9 | 5.3 | 3.3 | 0.018 | 0.042 |
| S | 0.016 | 0.24 | 0.50 | 0.012 | 0.0011 | 23.4 | 5.8 | 3.1 | 6.2 | 0.016 | 0.036 |
| T | 0.011 | 0.21 | 0.42 | 0.016 | 0.0009 | 26.4 | 6.2 | 2.8 | 2.4 | 0.062 | 0.024 |
| U | 0.016 | 0.49 | 0.39 | 0.013 | 0.0009 | 25.5 | 6.3 | 4.0 | 2.7 | 0.016 | 0.073 |

| Steel No. | Composition (mass %) W | V | Zr | B | REM | Ca | Sn | Mg | Ta | Co | Sb |
|---|---|---|---|---|---|---|---|---|---|---|---|
| A | — | — | — | — | — | — | — | — | — | — | — |
| B | — | — | — | — | — | — | — | — | — | — | — |
| C | 0.38 | — | — | — | — | — | — | — | — | — | — |
| D | 0.45 | — | — | — | — | — | — | — | — | — | — |
| E | 0.44 | 0.061 | — | — | 0.0023 | — | — | — | — | — | — |
| F | 0.88 | — | — | — | — | — | — | 0.0007 | — | — | 0.023 |
| G | — | — | — | 0.0027 | — | 0.0019 | — | — | 0.044 | — | — |
| H | — | 0.044 | 0.18 | — | — | 0.0039 | — | — | — | — | — |
| I | 1.11 | 0.086 | — | 0.0017 | — | — | 0.18 | — | — | 0.041 | — |
| J | 0.46 | — | 0.21 | — | — | — | — | — | 0.056 | 0.031 | — |
| K | — | — | — | 0.0021 | 0.0035 | — | 0.13 | 0.0024 | — | — | — |
| L | — | — | — | — | — | — | — | — | — | — | — |
| M | — | — | — | — | — | — | — | — | — | — | — |
| N | — | — | — | — | — | 0.0026 | — | — | — | — | 0.046 |
| O | — | — | — | — | — | 0.0026 | — | — | — | — | 0.046 |
| P | 0.11 | — | — | — | — | — | 0.18 | — | — | — | — |
| Q | — | 0.059 | — | — | 0.0089 | — | — | — | 0.028 | — | — |
| R | — | — | — | — | — | — | — | — | — | — | 0.021 |
| S | — | — | 0.21 | — | — | — | — | — | 0.022 | — | — |
| T | 0.55 | — | — | 0.0035 | — | — | — | — | — | 0.034 | — |
| U | — | — | — | — | 0.0019 | — | — | 0.0068 | — | — | — |

* Underline means outside the range of the invention

This was followed by the σ-phase precipitation treatment, in which the seamless steel pipe was heated, and cooled to a temperature of 300° C. or less under the conditions shown in Table 2. After the σ-phase precipitation treatment, the seamless steel pipe was subjected to the solution heat treatment, in which the seamless steel pipe was heated under the conditions shown in Table 2, and cooled to a temperature of 300° C. or less. This was followed by the aging heat treatment, in which the seamless steel pipe subjected to the solution heat treatment was further heated under the conditions shown in Table 2, and air cooled at an average cooling rate of 1° C./s or more. In the σ-phase precipitation treatment and solution heat treatment, the seamless steel pipe was cooled at an average cooling rate of 1° C./s or more in the case of air cooling, and 10° C./s or more in the case of water cooling.

TABLE 2

| Steel pipe No. | Steel No. | σ-Phase precipitation treatment Heating temp. (° C.) | Retention time (min) | Cooling | Cooling stop temp. (° C.) | Solution heat treatment Heating temp. (° C.) | Retention time (min) | Cooling | Cooling stop temp. (° C.) | Aging heat treatment Heating temp. (° C.) | Retention time (min) |
|---|---|---|---|---|---|---|---|---|---|---|---|
| 1 | A | 800 | 30 | Water cooling | 30 | 1070 | 30 | Water cooling | 30 | 400 | 30 |
| 2 | A | 800 | 30 | Water cooling | 30 | 1070 | 30 | Water cooling | 30 | 450 | 30 |
| 3 | A | 800 | 30 | Water cooling | 30 | 1070 | 30 | Water cooling | 30 | 500 | 30 |
| 4 | A | 800 | 30 | Water cooling | 30 | 1070 | 30 | Water cooling | 30 | 550 | 30 |
| 5 | B | 800 | 30 | Water cooling | 200 | 1070 | 30 | Water cooling | 30 | 500 | 30 |

TABLE 2-continued

| | | σ-Phase precipitation treatment | | | | Solution heat treatment | | | | Aging heat treatment | |
|---|---|---|---|---|---|---|---|---|---|---|---|
| Steel pipe No. | Steel No. | Heating temp. (° C.) | Retention time (min) | Cooling | Cooling stop temp. (° C.) | Heating temp. (° C.) | Retention time (min) | Cooling | Cooling stop temp. (° C.) | Heating temp. (° C.) | Retention time (min) |
| 6 | C | 750 | 30 | Water cooling | 300 | 1070 | 30 | Water cooling | 30 | 500 | 30 |
| 7 | D | 750 | 30 | Water cooling | 30 | 1070 | 30 | Water cooling | 150 | 500 | 30 |
| 8 | E | 750 | 30 | Water cooling | 30 | 1070 | 30 | Water cooling | 300 | 550 | 30 |
| 9 | F | 900 | 30 | Water cooling | 200 | 1070 | 30 | Water cooling | 30 | 500 | 30 |
| 10 | G | 900 | 30 | Water cooling | 200 | 1070 | 30 | Water cooling | 30 | 500 | 30 |
| 11 | H | 900 | 30 | Water cooling | 200 | 1070 | 30 | Water cooling | 30 | 500 | 30 |
| 12 | I | 900 | 30 | Water cooling | 200 | 1070 | 30 | Water cooling | 30 | 500 | 30 |
| 13 | J | 800 | 30 | Water cooling | 200 | 1070 | 30 | Water cooling | 30 | 500 | 30 |
| 14 | K | 800 | 30 | Water cooling | 200 | 1070 | 30 | Water cooling | 30 | 500 | 30 |
| 15 | B | 800 | 30 | Water cooling | 200 | 950 | 30 | Water cooling | 30 | 500 | 30 |
| 16 | B | — | — | — | — | 1070 | 30 | Water cooling | 30 | 400 | 30 |
| 17 | B | — | — | — | — | 1070 | 30 | Water cooling | 30 | 450 | 30 |
| 18 | B | — | — | — | — | 1070 | 30 | Water cooling | 30 | 500 | 30 |
| 19 | B | — | — | — | — | 1070 | 30 | Water cooling | 30 | 550 | 30 |
| 20 | L | 800 | 30 | Water cooling | 30 | 1070 | 30 | Water cooling | 200 | 500 | 30 |
| 21 | M | 800 | 30 | Water cooling | 30 | 1070 | 30 | Water cooling | 200 | 500 | 30 |
| 22 | N | 800 | 30 | Water cooling | 30 | 1070 | 30 | Water cooling | 200 | 500 | 30 |
| 23 | O | 800 | 30 | Water cooling | 30 | 1070 | 30 | Water cooling | 200 | 500 | 30 |
| 24 | P | 800 | 30 | Water cooling | 30 | 1070 | 30 | Water cooling | 200 | 500 | 30 |
| 25 | Q | 800 | 30 | Water cooling | 30 | 1070 | 30 | Water cooling | 200 | 500 | 30 |
| 26 | R | 800 | 30 | Water cooling | 30 | 1070 | 30 | Water cooling | 30 | 500 | 30 |
| 27 | S | 800 | 30 | Water cooling | 30 | 1070 | 30 | Water cooling | 30 | 500 | 30 |
| 28 | T | 800 | 30 | Water cooling | 150 | 1070 | 30 | Water cooling | 30 | 500 | 30 |
| 29 | U | 800 | 30 | Water cooling | 150 | 1070 | 30 | Water cooling | 30 | 500 | 30 |
| 30 | A | 680 | 30 | Water cooling | 150 | 1070 | 30 | Water cooling | 30 | 500 | 30 |
| 31 | A | 980 | 30 | Water cooling | 150 | 1070 | 30 | Water cooling | 30 | 500 | 30 |
| 32 | A | 800 | 30 | Water cooling | 150 | 1070 | 30 | Water cooling | 30 | 325 | 30 |
| 33 | A | 800 | 30 | Water cooling | 150 | 1070 | 30 | Water cooling | 30 | 625 | 30 |
| 34 | A | 800 | 30 | Air cooling | 30 | 1070 | 30 | Water cooling | 300 | 500 | 30 |
| 35 | A | 800 | 30 | Water cooling | 30 | 1070 | 30 | Air cooling | 30 | 500 | 30 |
| 36 | A | 800 | 30 | Water cooling | 30 | 1070 | 30 | Water cooling | 30 | 700 | 120 |
| 37 | A | 800 | 30 | Water cooling | 400 | 1070 | 30 | Water cooling | 30 | 450 | 30 |
| 38 | A | 800 | 30 | Water cooling | 30 | 1070 | 30 | Water cooling | 400 | 450 | 30 |

* Underline means outside the range of the invention

TABLE 3

| | | Microstructure | | | | Tensile properties | |
|---|---|---|---|---|---|---|---|
| Steel pipe No. | Steel No. | Volume fraction of ferrite phase (%) | Volume fraction of austenitic phase (%) | Cu content in ferrite (mass %) | Value on left-hand side of formula (1) | Yield strength YS (MPa) | Tensile strength TS (MPa) |
| 1 | A | 46 | 54 | 2.08 | 0.91 | 659 | 826 |
| 2 | A | 46 | 54 | 2.06 | 0.89 | 750 | 876 |
| 3 | A | 45 | 55 | 2.08 | 0.91 | 726 | 909 |
| 4 | A | 47 | 53 | 2.09 | 0.92 | 689 | 868 |
| 5 | B | 59 | 41 | 2.16 | 0.90 | 711 | 916 |
| 6 | C | 47 | 53 | 1.90 | 0.85 | 695 | 933 |
| 7 | D | 51 | 49 | 2.21 | 0.91 | 689 | 916 |
| 8 | E | 43 | 57 | 3.06 | 0.93 | 702 | 904 |
| 9 | F | 66 | 34 | 2.66 | 0.89 | 723 | 876 |
| 10 | G | 72 | 28 | 2.86 | 0.92 | 740 | 879 |
| 11 | H | 43 | 57 | 2.24 | 0.90 | 690 | 868 |
| 12 | I | 66 | 34 | 2.22 | 0.89 | 688 | 860 |
| 13 | J | 38 | 62 | 1.89 | 0.84 | 711 | 911 |
| 14 | K | 50 | 50 | 1.58 | 0.79 | 732 | 916 |
| 15 | B | 42 | 58 | 2.18 | 0.92 | 691 | 921 |
| 16 | B | 58 | 42 | 2.22 | 0.96 | 661 | 830 |
| 17 | B | 59 | 41 | 2.21 | 0.95 | 746 | 875 |
| 18 | B | 59 | 41 | 2.22 | 0.96 | 721 | 900 |
| 19 | B | 58 | 42 | 2.23 | 0.97 | 693 | 871 |
| 20 | L | 30 | 70 | 1.80 | 0.92 | 730 | 919 |
| 21 | M | 54 | 46 | 1.25 | 0.91 | 598 | 721 |
| 22 | N | 51 | 49 | 1.84 | 0.89 | 721 | 897 |
| 23 | O | 47 | 53 | 1.89 | 0.90 | 720 | 901 |
| 24 | P | 82 | 18 | 1.95 | 0.92 | 746 | 886 |
| 25 | Q | 13 | 87 | 1.44 | 0.86 | 521 | 711 |
| 26 | R | 62 | 38 | 2.42 | 0.90 | 751 | 902 |

TABLE 3-continued

| | | | | | | | |
|---|---|---|---|---|---|---|---|
| 27 | S | 32 | 68 | 3.82 | 0.89 | 770 | 942 |
| 28 | T | 67 | 33 | 1.91 | 0.91 | 762 | 911 |
| 29 | U | 57 | 43 | 2.09 | 0.88 | 757 | 926 |
| 30 | A | 47 | 53 | 2.13 | 0.96 | 729 | 907 |
| 31 | A | 45 | 55 | 2.14 | 0.97 | 728 | 911 |
| 32 | A | 46 | 54 | 2.07 | 0.90 | 610 | 729 |
| 33 | A | 45 | 55 | 2.07 | 0.90 | 602 | 720 |
| 34 | A | 44 | 56 | 2.07 | 0.90 | 716 | 899 |
| 35 | A | 41 | 59 | 2.08 | 0.91 | 720 | 902 |
| 36 | A | 41 | 59 | 2.08 | 0.91 | 735 | 946 |
| 37 | A | 40 | 60 | 2.10 | 0.93 | 786 | 967 |
| 38 | A | 43 | 57 | 2.08 | 0.91 | 793 | 950 |

| | Toughness | Corrosion test | | SCC resistance test | SSC resistance test | |
|---|---|---|---|---|---|---|
| Steel pipe No. | Absorption energy $vE_{-10}$ (J) | Corrosion rate (mm/y) | Presence or absence of pitting corrosion | Presence or absence of cracking and pitting corrosion | Presence or absence of cracking and pitting corrosion | Remarks ** |
| 1 | 158 | 0.010 | ○ | ○ | ○ | PE |
| 2 | 60 | 0.010 | ○ | ○ | ○ | PE |
| 3 | 86 | 0.010 | ○ | ○ | ○ | PE |
| 4 | 91 | 0.010 | ○ | ○ | ○ | PE |
| 5 | 88 | 0.010 | ○ | ○ | ○ | PE |
| 6 | 62 | 0.010 | ○ | ○ | ○ | PE |
| 7 | 49 | 0.010 | ○ | ○ | ○ | PE |
| 8 | 55 | 0.010 | ○ | ○ | ○ | PE |
| 9 | 89 | 0.010 | ○ | ○ | ○ | PE |
| 10 | 80 | 0.010 | ○ | ○ | ○ | PE |
| 11 | 73 | 0.010 | ○ | ○ | ○ | PE |
| 12 | 64 | 0.010 | ○ | ○ | ○ | PE |
| 13 | 69 | 0.010 | ○ | ○ | ○ | PE |
| 14 | 55 | 0.010 | ○ | ○ | ○ | PE |
| 15 | 11 | 0.010 | ○ | ○ | ○ | CE |
| 16 | 132 | 0.010 | ○ | × | × | CE |
| 17 | 65 | 0.010 | ○ | × | × | CE |
| 18 | 71 | 0.010 | ○ | × | × | CE |
| 19 | 93 | 0.010 | ○ | × | × | CE |
| 20 | 70 | 0.010 | ○ | × | × | CE |
| 21 | 184 | 0.010 | ○ | ○ | ○ | CE |
| 22 | 57 | 0.010 | ○ | × | × | CE |
| 23 | 60 | 0.010 | ○ | × | × | CE |
| 24 | 8 | 0.010 | ○ | × | × | CE |
| 25 | 197 | 0.010 | ○ | ○ | ○ | CE |
| 26 | 8 | 0.010 | ○ | × | × | CE |
| 27 | 7 | 0.010 | ○ | ○ | ○ | CE |
| 28 | 15 | 0.010 | ○ | ○ | ○ | CE |
| 29 | 42 | 0.010 | ○ | × | × | CE |
| 30 | 83 | 0.010 | ○ | × | × | CE |
| 31 | 81 | 0.010 | ○ | × | × | CE |
| 32 | 62 | 0.010 | ○ | ○ | ○ | CE |
| 33 | 8 | 0.010 | ○ | × | × | CE |
| 34 | 92 | 0.010 | ○ | ○ | ○ | PE |
| 35 | 88 | 0.010 | ○ | ○ | ○ | PE |
| 36 | 88 | 0.148 | × | × | × | CE |
| 37 | 9 | 0.010 | ○ | ○ | ○ | CE |
| 38 | 13 | 0.010 | ○ | ○ | ○ | CE |

Formula (1): $0.55[\%C] - 0.056[\%Si] + 0.018[\%Mn] - 0.020[\%Cr] - 0.087[\%Mo] + 0.16[\%Ni] + 0.28[\%N] - 0.506[\%Cu] - 0.035[\%W] + [\%Cu*F] \leq 0.94$

* Underline means outside the range of the invention

** PE: Present Example; CE: Comparative Example

After the σ-phase precipitation treatment, solution heat treatment, and aging heat treatment (hereinafter, these will be also collectively referred to simply as "heat treatment"), a test specimen for microstructure observation was taken from the seamless steel pipe (duplex stainless steel pipe), and was examined in a microstructure quantification evaluation, a tensile test, a Charpy impact test, a corrosion test, a sulfide stress cracking resistance test (SSC resistance test), and a sulfide stress corrosion cracking resistance test (SCC resistance test). The tests were conducted in the manner described below. The test results are presented in Table 3.

(1) Measurement of Volume Fraction (Volume %) of Each Phase in Whole Microstructure of Steel Pipe After the heat treatment, a test specimen for microstructure observation was taken from the seamless steel pipe (duplex stainless steel pipe) for observation of an axial cross section. For the ferrite phase and austenitic phase, the volume fraction was determined by observing the cross section with a scanning electron microscope. Specifically, the test specimen for microstructure observation was corroded with a Vilella's solution (a mixed reagent containing 2 g of picric acid, 10 ml of hydrochloric acid, and 100 ml of ethanol), and the microstructure was photographed with a scanning electron microscope (1,000×). From the micrograph of the microstructure, a mean area ratio was calculated for the ferrite phase and the austenitic phase using an image analyzer, and the calculated value was determined as the volume fraction (volume %) of each phase.

(2) Measurement of Cu Content in Ferrite Phase

A test specimen prepared in the same manner as for the microstructure observation was examined for ferrite identification by EBSP analysis. For the phase identified as ferrite in each test specimen, the Cu content was determined by measuring the specimen at arbitrarily selected 20 points by FE-EPMA. A mean value of the quantified Cu content values was then determined as the Cu content (mass %) of the ferrite phase in the steel.

(3) Tensile Test

After the heat treatment, a strip specimen specified by API standard was taken from the seamless steel pipe (duplex stainless steel pipe) in such an orientation that the tensile direction was along the axial direction of the pipe, in compliance with the API-5CT standards. In the tensile test conducted in compliance with the API standards, each test specimen was measured for yield strength YS (MPa) and tensile strength TS (MPa) as measures of tensile properties.

(4) Charpy Impact Test

After the heat treatment, a V-notch test specimen (10-mm thick) of a length equal to the circumference of the seamless steel pipe (duplex stainless steel pipe) was taken from the center of the wall thickness, in compliance with the ISO-11960 standards. The test specimen was measured for absorption energy $vE_{-10}$ (J) in a Charpy impact test conducted at a test temperature of −10° C. The measurement was conducted for three test specimens taken from each steel pipe, and an arithmetic mean value from the three test specimens was calculated after the Charpy impact test. The results are presented in Table 3.

(5) Corrosion Test (Carbon Dioxide Gas Corrosion Resistance Test)

After the heat treatment, the seamless steel pipe (duplex stainless steel pipe) was machined to prepare a corrosion test specimen measuring 3 mm in thickness, 30 mm in width, and 40 mm in length. Each test specimen was then tested in a corrosion test for evaluation of carbon dioxide gas corrosion resistance.

In the corrosion test, the test specimen was immersed in a test solution (a 20 mass % NaCl aqueous solution; liquid temperature: 200° C.; a 3.0 MPa $CO_2$ atmosphere) held in an autoclave, and the weight of the specimen was measured after 14 days (336 hours) of immersion in the solution. The corrosion rate was determined from the weight reduction relative to the weight before the test. After the corrosion test, the test specimen was observed for the presence or absence of pitting corrosion on a surface of the test specimen, using a 10× loupe. Here, pitting corrosion being present means that pitting corrosion having a diameter of 0.2 mm or more is present. In accordance with aspects of the present invention, the specimens were determined as being acceptable when the corrosion rate was 0.125 mm/y or less and pitting corrosion was absent. In Table 3, the symbol "○" indicates that pitting corrosion is absent, and the symbol "x" indicates that pitting corrosion is present.

(6) Sulfide Stress Cracking Resistance Test (SSC Resistance Test)

After the heat treatment, the seamless steel pipe (duplex stainless steel pipe) was machined to prepare a round rod-shaped test specimen (diameter ϕ=6.4 mm), in compliance with NACE TM0177, Method A, and the specimen was tested in an SSC resistance test.

In the SSC resistance test, the test specimen was immersed in a test solution (an aqueous solution that had been adjusted to pH 3.5 by addition of acetic acid and sodium acetate to a 20 mass % NaCl aqueous solution (liquid temperature: 25° C.; an atmosphere of 0.03 MPa $H_2S$ and 0.07 MPa $CO_2$)) for 720 hours under an applied stress equal to 90% of the yield stress. The test specimen was then visually inspected for the presence or absence of cracking. The test specimen was also observed for the presence or absence of pitting corrosion on its surface, using a 10× loupe. In accordance with aspects of the present invention, the test specimens were determined as being acceptable when cracking and pitting corrosion were absent after the test. In Table 3, the symbol "○" indicates that cracking and pitting corrosion are absent, and the symbol "x" indicates that cracking and/or pitting corrosion are present.

(7) Sulfide Stress Corrosion Cracking Resistance Test (SCC Resistance Test)

After the heat treatment, the seamless steel pipe (duplex stainless steel pipe) was machined to prepare a 4-point bending test specimen measuring 3 mm in thickness, 15 mm in width, and 115 mm in length, and the specimen was tested in an SCC resistance test.

In the SCC resistance test, the test specimen was immersed in a test solution (a 10 mass % NaCl aqueous solution; liquid temperature: 80° C.; an atmosphere of 35 kPa $H_2S$ and 2 MPa $CO_2$) in an autoclave for 720 hours under an applied stress equal to 100% of the yield stress. The test specimen was then visually inspected for the presence or absence of cracking on its surface. The test specimen was also observed for the presence or absence of pitting corrosion on its surface, using a 10× loupe. In accordance with aspects of the present invention, the test specimens were determined as being acceptable when cracking and pitting corrosion were absent after the test. In Table 3, the symbol "○" indicates that cracking and pitting corrosion are absent, and the symbol "x" indicates that cracking and/or pitting corrosion are present.

The duplex stainless steel pipes of the present examples all had high strength with a yield strength of 655 MPa or more, and high toughness with an absorption energy $vE_{-10}$ of 40 J or more as measured by a Charpy impact test. The duplex stainless steel pipes of the present examples also had excellent corrosion resistance (carbon dioxide gas corrosion resistance) in a $CO_2$- and $Cl^-$-containing high-temperature corrosive environment of 200° C. or more, and excellent sulfide stress cracking resistance and sulfide stress corrosion cracking resistance as demonstrated by the absence of cracking (in both SSC and SCC) in a $H_2S$-containing environment. In contrast, in comparative examples that did not fall in the ranges according to aspects of the present invention, the levels of high strength or high toughness desired in accordance with aspects of the present invention were not achievable, and the corrosion rate was excessively high as demonstrated by the pitting corrosion occurring in a $CO_2$- and $Cl^-$-containing high-temperature corrosive environment of 200° C. or more. Comparative examples also had cracking (SSC or SCC, or both) in a $H_2S$-containing environment.

The invention claimed is:

1. A duplex stainless steel having a composition comprising, in mass %,

C: 0.03% or less,

Si: 1.0% or less,

Mn: 0.10 to 1.5%,

P: 0.040% or less,

S: 0.01% or less,

Cr: 20.0 to 28.0%,
Ni: 2.0 to 10.0%,
Mo: 2.0 to 5.0%,
Cu: 2.0 to 6.0%,
Al: 0.001 to 0.05%, and
N: less than 0.070%,
and in which the balance is Fe and incidental impurities,
the duplex stainless steel having a microstructure containing an austenitic phase and a ferrite phase, and satisfying the following contents for C, Si, Mn, Cr, Mo, Ni, N, Cu, and W in the formula (1) below,
the duplex stainless steel having a yield strength YS of 655 MPa or more, and an absorption energy $vE_{-10}$ of 40 J or more as measured by a Charpy impact test at a test temperature of −10° C., $$0.55[\%\ C]-0.056[\%\ Si]+0.018[\%\ Mn]-0.020[\%\ Cr]-0.087[\%\ Mo]+0.16[\%\ Ni]+0.28[\%\ N]-0.506[\%\ Cu]-0.035[\%\ W]+[\%\ Cu^{*}F]\leq 0.94 \quad (1),$$

wherein [% symbol of elements] represents the content (mass %) of the element in the steel, [% symbol of elements *F] represents the content (mass %) of the element in the ferrite phase, and the contents are zero for elements that are not contained.

2. The duplex stainless steel according to claim 1, wherein the composition further comprises, in mass %, one or two or more groups selected from the following groups A to E,
group A: W: 1.5% or less,
group B: V: 0.20% or less,
group C: one or two selected from Zr: 0.50% or less, and B: 0.0030% or less,
group D: one or two or more selected from REM: 0.005% or less, Ca: 0.005% or less, Sn: 0.20% or less, and Mg: 0.01% or less,
group E: one or two or more selected from Ta: 0.1% or less, Co: 1.0% or less, and Sb: 1.0% or less.

3. A duplex stainless steel pipe using the duplex stainless steel of claim 1.

4. The duplex stainless steel pipe according to claim 3, wherein the composition of the duplex stainless steel further comprises, in mass %, one or two or more groups selected from the following groups A to E,
group A: W: 1.5% or less,
group B: V: 0.20% or less,
group C: one or two selected from Zr: 0.50% or less, and B: 0.0030% or less,
group D: one or two or more selected from REM: 0.005% or less, Ca: 0.005% or less, Sn: 0.20% or less, and Mg: 0.01% or less,
group E: one or two or more selected from Ta: 0.1% or less, Co: 1.0% or less, and Sb: 1.0% or less.

5. A method for manufacturing a duplex stainless steel, comprising subjecting a steel material of the composition of claim 1 to
a σ-phase precipitation treatment that heats the steel material to a temperature of 700° C. or more and 950° C. or less, and cools the heated steel material to a temperature of 300° C. or less at an average cooling rate of air cooling or faster,
a solution heat treatment that heats the steel material to a temperature of 1,000° C. or more, and cools the heated steel material to a temperature of 300° C. or less at an average cooling rate of air cooling or faster, and an aging heat treatment that heats the steel material to a temperature of 350 to 600° C., and cools the heated steel material.

6. The method for manufacturing a duplex stainless steel according to claim 5, wherein the composition further comprises, in mass %, one or two or more groups selected from the following groups A to E,
group A: W: 1.5% or less,
group B: V: 0.20% or less,
group C: one or two selected from Zr: 0.50% or less, and B: 0.0030% or less,
group D: one or two or more selected from REM: 0.005% or less, Ca: 0.005% or less, Sn: 0.20% or less, and Mg: 0.01% or less,
group E: one or two or more selected from Ta: 0.1% or less, Co: 1.0% or less, and Sb: 1.0% or less.

* * * * *